US008833611B2

(12) United States Patent
Bouwer

(10) Patent No.: US 8,833,611 B2
(45) Date of Patent: Sep. 16, 2014

(54) DRIP GUARD

(76) Inventor: Gustav Bouwer, Gauteng (ZA)

( * ) Notice: Subject to any disclaimer, the term of this patent is extended or adjusted under 35 U.S.C. 154(b) by 0 days.

(21) Appl. No.: 13/116,451

(22) Filed: May 26, 2011

(65) Prior Publication Data

US 2011/0290822 A1 Dec. 1, 2011

(30) Foreign Application Priority Data

May 26, 2010 (ZA) ..... 2009/08433

(51) Int. Cl.
*B67D 1/16* (2006.01)
*B65D 23/06* (2006.01)
*B65D 6/40* (2006.01)

(52) U.S. Cl.
CPC ..... *B65D 23/065* (2013.01); *B65D 7/40* (2013.01); *B67D 1/16* (2013.01)
USPC ..... 222/108; 215/41

(58) Field of Classification Search
CPC ..... B67D 1/16; B65D 7/40; B65D 32/06; B65D 32/065
USPC ..... 222/108, 111, 571; 215/41, 392–394; 220/108, 111, 571
See application file for complete search history.

(56) References Cited

U.S. PATENT DOCUMENTS

| | | | | | |
|---|---|---|---|---|---|
| 1,449,335 | A | * | 3/1923 | Latham | 215/392 |
| 1,632,347 | A | * | 6/1927 | Pipkin | 215/395 |
| 1,683,176 | A | * | 9/1928 | Faulhaber | 215/392 |
| 1,917,953 | A | * | 7/1933 | Davis | 215/394 |
| 2,035,384 | A | * | 3/1936 | Hinchliff | 66/170 |
| 2,058,915 | A | * | 10/1936 | Scholl | 215/395 |
| 2,317,046 | A | * | 4/1943 | Fleming | 220/717 |
| 3,926,348 | A | * | 12/1975 | Lutzker | 222/189.07 |
| 4,312,523 | A | * | 1/1982 | Haines | 40/630 |
| 4,437,583 | A | * | 3/1984 | O'Connor | 222/108 |
| 4,871,597 | A | * | 10/1989 | Hobson | 428/36.1 |
| 5,609,759 | A | * | 3/1997 | Nohren et al. | 210/266 |
| 5,676,401 | A | * | 10/1997 | Witkowski et al. | 283/81 |
| 5,765,716 | A | * | 6/1998 | Cai et al. | 220/740 |
| 6,325,247 | B1 | * | 12/2001 | Iggulden | 222/108 |
| 6,601,728 | B1 | * | 8/2003 | Newkirk et al. | 220/739 |
| 6,718,733 | B2 | * | 4/2004 | Kilmartin | 53/397 |
| 6,745,913 | B2 | * | 6/2004 | Abraham | 215/11.6 |
| 6,787,210 | B2 | * | 9/2004 | Stickler | 428/41.7 |
| 7,128,243 | B2 | | 10/2006 | Fallaha | |

(Continued)

FOREIGN PATENT DOCUMENTS

| | | | | |
|---|---|---|---|---|
| CA | 2489609 | * | 12/2004 | 215/392 |
| JP | 6-153779 A | * | 6/1994 | 426/323 |
| WO | WO-2007/138481 | * | 2/2007 | 215/392 |
| WO | WO-2010/013009 A1 | * | 2/2010 | 215/392 |

*Primary Examiner* — Lien Ngo

(74) *Attorney, Agent, or Firm* — Kevin R. Erdman; Brannon Sowers & Cracraft PC

(57) ABSTRACT

This invention relates to a drip guard which is securable to a container and which functions to inhibit or absorb condensation and/or liquid droplets formed on an outer surface of a liquid container. The drip guard has a flexible body which is securable to a liquid container and, in one embodiment, the body functions to inhibit the formation of liquid droplets when the liquid is poured from the container or restrain already formed liquid droplets. In another embodiment the body absorbs condensation or droplets forming on the liquid container in which case the body may be absorbent or it may include an absorbent layer. The body may bear indicia such as, for example, advertising material.

14 Claims, 3 Drawing Sheets

(56) References Cited

U.S. PATENT DOCUMENTS

| | | | | |
|---|---|---|---|---|
| 7,156,253 | B2 * | 1/2007 | Ziegler | 220/375 |
| 7,431,175 | B2 * | 10/2008 | Heilos | 220/717 |
| 7,926,851 | B2 * | 4/2011 | Kaufman | 283/81 |
| 8,136,263 | B2 * | 3/2012 | Schmid | 34/283 |
| 8,245,840 | B2 * | 8/2012 | Boorstein | 206/209.1 |
| 8,298,174 | B2 * | 10/2012 | Showers | 604/77 |
| 2008/0282908 | A1 * | 11/2008 | Cole et al. | 99/495 |

* cited by examiner

DRIP GUARD

CROSS-REFERENCE TO RELATED APPLICATION

This application claims priority to a South African Patent Application Serial No. 2009/08433 filed May 26, 2010, the disclosure of which is expressly incorporated herein by reference.

FIELD OF THE INVENTION

The invention relates to a drip guard to guard against the collection of residual liquid on the outside of a container from which a liquid is being poured.

BACKGROUND TO THE INVENTION

Containers, particularly bottles and tins, are used to contain a variety of liquids, for example liquids fit for human consumption such as beverages, or liquids such as chemical compounds, which are applicable in various industrial, domestic, and laboratory settings.

When a liquid is poured out of the bottle a residual amount of liquid tends to collect on the outside of the bottle neck and it can then run down the bottle and make contact with a surface upon which the bottle rests. This is a common problem and can result in either the surface or a user who makes contact with the bottle neck coming into direct contact with the liquid. Such direct contact can cause the user or the surface on which the bottle rests to become exposed either to hazardous or potentially hazardous chemicals, where the bottle contains chemicals, or to wine or other beverages which can cause the users' hands or the surface upon which the bottle rests to become stained or sticky.

A number of devices have been developed to address the collection of and subsequent contact with residual liquids, for example the so-called drip-less pouring insert or drip stop and the drip prevention apparatus. The drip-less pouring insert comprises an insert which is wedged into a neck region of the bottle so that the insert is located within the neck of the bottle and protrudes from the bottle thereby forming a channel through which the liquid to be dispensed is poured. The drip prevention apparatus, which is similar to the drip-less pouring insert in that they both function to reduce dripping, is an attachment which is placed over the neck region of the bottle and attached thereto thereby facilitating the pouring of the liquid through an orifice in the apparatus so as to minimise residual liquid collection on the outside of the container. Due to the design of the drip prevention apparatus, each type of bottle must have a custom made drip prevention apparatus which is not preferable when a manufacturer is manufacturing a wide range of different bottle products. The problem with both the drip-less pouring insert and the drip prevention apparatus is that they tend to accumulate liquid residue. Unless they are washed after every use this accumulation of liquid residue may serve as a breeding ground for microorganisms. Hence repeated use, without washing causes these devices to become unhygienic. Furthermore, the drip less pouring insert is assembled by rolling a metal sheet into a pipe shape prior to inserting it into the bottle and as such it comes into contact with the user's hands, which is also unhygienic.

The contact between the liquid being dispensed from the container and the drip-less pouring insert or the drip prevention apparatus may be undesirable in certain applications. For example, wine drinkers may not want, for reasons of either wine drinking tradition or perceived taste reasons, a wine to make contact with an insert or apparatus before it is imbibed.

The primary purposes of both of these devices is to reduce dripping and not to prevent droplet formation and as such there may still be a buildup of droplets of either wine or a hazardous chemical and it is foreseeable that the user could still become exposed to these droplets, especially when the user removes the device from the bottle. Furthermore, since these devices are not designed to restrain liquid droplets that have formed, by whatever means, on the outside of a bottle, it is foreseeable that the users' hands or the surface upon which the bottle rests could become exposed to droplets.

The integrated drip proof stopper system, as described in U.S. Pat. No. 7,128,243, is also known. This is a complex system comprising a ring which is slid into a bottle cap during the bottle manufacturing process. This system must be added during the manufacturing process and cannot be added by suppliers, wholesalers or users, furthermore, each type of bottle must have a custom made drip proof stopper which is not preferable when a manufacturer is manufacturing a wide range of different bottle products. To access the integrated drip proof stopper, the bottle cap must be opened and the integrated drip proof stopper slid away from the cap onto a neck region of the bottle. Due to the fact that the integrated drip proof stopper is not attached directly to the bottle but merely slidably located within the bottle cap it is possible that such stoppers may become damaged during the bottle capping process. Furthermore, the integrated drip proof stopper has a shrink wrap shell which must be opened by the user and the user must ensure an absorbent pad, located under the shrink wrap shell, is exposed so that the pad can receive any residual liquid. The shrink wrap shell may become torn either when the integrated drip proof stopper is slid away from the bottle cap or when the shrink wrap shell is opened to expose the absorbent pad. The efficacy of the system also depends on the user ensuring that the absorbent pad is correctly and fully exposed before the liquid is poured from the container.

Drip-stop rings are devices, particularly metal ring devices, which have integrated absorbent pads and that are secured to the neck region of a bottle, in particular wine bottles, to reduce the seeping of liquid down the bottle. These devices are characterised by having a rigid, non-flexible outer part, usually made of metal, which pushes the absorbent pads against the neck region of the bottle. The outer part may be a single, solid ring, in which case the ring is placed over the neck of the bottle and pushes the absorbent material against the neck of the bottle. A problem with these solid ring devices is that they tend to weakly push the absorbent pads onto the bottle, which is undesirable, and because they are simply placed over the neck of the bottle, as opposed to being clamped, they tend to move with a resultant reduction in pressure on the absorbent pads when the bottle is titled, such as when pouring liquid out of the bottle. In an alternative design, the drip-stop ring has a hinge mechanism that allows two rigid, non-flexible half-circles to be brought together to form a rigid circular structure around the bottle neck and thus push the absorbent material against the bottle. The hinge increases the complexity of the device.

Due to the non-flexible, rigid nature and the fixed diameter of the outer clamping part, drip-stop rings have to be manufactured for specific bottles, which is not preferable when a manufacturer is manufacturing a wide range of different bottle products or when it is desirable to fit the device to a wide range of different bottle products. Another problem with drip-stop rings is that these devices and in particular the absorbent pads tend to accumulate liquid residue. Unless they are replaced after every use this accumulation of liquid residue may make the devices unsightly and may serve as a breeding ground for microorganisms and cause these devices to become unhygienic.

Finally, the known devices are generally manufactured from metal, or wood or a plastics material and are generally shaped so as to fit a particular bottle design and a particular portion of the bottle, in particular the neck of the bottle. The materials used in the manufacture of such devices are generally expensive and hence such devices are normally intended to be reusable devices, which as shown above can lead to hygiene problems if the devices are not regularly washed. Furthermore, the design of these devices does not facilitate the easy attachment of indicia, such as, advertisements or product warnings, thereto and are therefore not used for this purpose.

OBJECT OF THE INVENTION

It is an object of this invention to provide for a drip guard which at least in part ameliorates the disadvantages as stated above.

SUMMARY OF THE INVENTION

In accordance with the invention there is provided a drip guard comprising a body having a securement means for securing the body to a liquid container, in use, the body functioning to inhibit the formation of liquid droplets when the liquid is poured from the container or restrain already formed liquid droplets.

There is also provided that the body is made of a flexible material so that, in use, the body can be wrapped around a neck region, alternatively a body region, further alternatively both the neck region and the body region of the liquid container.

There is further provided that the flexible material is a plastics material, alternatively a paper material, preferably cardboard or carton board, further alternatively a wooden material or further alternatively a metal or even further alternatively a combination of the above materials.

There is further provided that the flexible material can be an absorbent flexible material.

There is further provided that the flexible material is a disposable material.

There is also provided that indicia can be displayed on the body.

There is further provided that the indicia can be printed directly on to the body, alternatively that the indicia can be affixed to the body.

There is further provided that the indicia can be affixed to the body by means of a label, alternatively a leaflet.

There is further provided that the indicia can be advertising or promotional indicia, alternatively personal messages, further alternatively general information, further alternatively product information or instructions, further alternatively indicia containing product warnings, said product warnings relating to the liquid contained in the liquid container.

There is also provided that the securement means, for securing the body to a liquid container, is an adhesive securement means, alternatively an interlinking securement means, further alternatively a magnetic securement means.

There is further provided that the adhesive securement means can be glue, alternatively adhesive tape.

In accordance with a first aspect of the invention there is provided that the body comprises an outer layer and an absorbent layer, the underside of the outer layer collaring the absorbent layer so as to hold the absorbent layer in abutment against the liquid container.

There is also provided that the absorbent layer is affixed to the outer layer, alternatively that the absorbent layer is merely held in abutment against the liquid container and is not directly affixed to the outer layer.

In accordance with a second aspect of the invention there is provided that the body comprises an outer layer, an inner layer and an absorbent layer sandwiched between the outer layer and the inner layer, the inner layer, in use, being securable to the liquid container.

In accordance with a third aspect of the invention there is provided that the body comprises a body region and a spout attachment, said spout attachment extending from the neck region of the liquid container, the spout attachment, in use, acting as a channel through which the liquid can be poured and acting as a means to reduce droplet formation.

There is also provided that the spout attachment is integrally formed with the body region.

There is also provided that the spout attachment is releasably securable to the body region.

There is further provided that the spout attachment can be releasably secured to the body region by adhesive securement means, alternatively an interlinking securement means, further alternatively a magnetic securement means.

There is also provided that the spout attachment has a spout housing and at least one sieve component located within an inner portion of the spout housing.

There is further provided that the at least one sieve component is integrally formed within the inner portion of the spout housing, alternatively that the at least one sieve component is removable from the spout housing.

There is further provided that the sieve component can act as a support to hold adjuncts, preferably adjuvants with which the liquid makes contact but which are not dispensed, alternatively adjuncts to be dispensed when the liquid is poured from the liquid container.

In accordance with a fourth aspect of the invention there is provided that the spout housing has at least one compartment located therein, the at least one compartment functioning to contain adjuncts, alternatively adjuvants.

There is also provided that the at least one compartment is an enclosed, alternatively and enclosable compartment.

Further detail about the precise features of the above invention shall become apparent in the claims.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
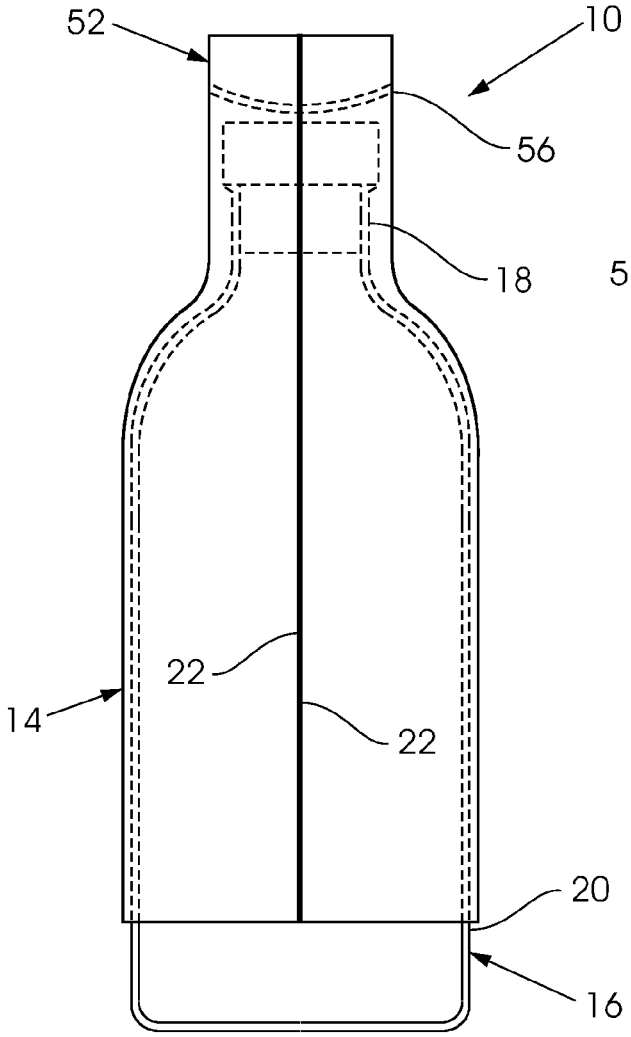
FIG. 1 is a side view of a drip guard having a spout attachment which is integrally formed with a flexible body, the spout attachment being fitted to a liquid container.

Corresponding reference characters indicate corresponding parts throughout the several views. Although the drawings represent embodiments of the present invention, the drawings are not necessarily to scale and certain features may be exaggerated in order to better illustrate and explain the present invention. The flow charts and screen shots are also representative in nature, and actual embodiments of the invention may include further features or steps not shown in the drawings. The exemplification set out herein illustrates an embodiment of the invention, in one form, and such exemplifications are not to be construed as limiting the scope of the invention in any manner.

DETAILED DESCRIPTION OF THE EMBODIMENTS OF THE INVENTION

The embodiments disclosed below are not intended to be exhaustive or limit the invention to the precise forms disclosed in the following detailed description. Rather, the embodiments are chosen and described so that others skilled in the art may utilize their teachings.

In FIGS. 1 to 7 of the drawings a drip guard (10), in accordance with the invention, is shown. The drip guard (10) has a flexible body (14), a securement means (12), which secures the body (14) to a liquid container (16), and a spout attachment (52) which is either attached or attachable to the body (14). The drip guard (10) functions to absorb condensation that forms on an outer surface of the liquid container (16) and/or to absorb liquid droplets which accumulate on the outer surface of the liquid container (16) when a liquid is poured from the liquid container (16).

Various possible embodiments of the body (14) are shown in FIGS. 4 to 7 and the body (14) is described further here below:

The body (14) is generally rectangular in shape but it is envisaged that bodies of various shapes may be used. For example bodies shaped like but not limited to cars or waves may be used.

The body (14) is relatively thin and is made of a flexible material such as, but not limited to, a plastics material or a paper material, such as cardboard or carton board, or a wooden material, such as bamboo, or a metal. It is envisaged that the body (14) may also be made of a combination of the above mentioned materials. The body (14) is generally made of a cheap material, such as but not limited to those described above, which can be easily disposed of so that the drip guard (10) may be applied once and not refitted onto other liquid containers for reuse. The fact that the drip guard (10) is not reusable means that the hygiene problems of the prior art are not experienced in this invention.

The flexible material may be an absorbent flexible material such as felt, filter paper, cotton wool, sponge or another type of absorbent material. The flexible material may also be paper coated with an absorbent substance forming an absorbent layer on the surface of the paper. Furthermore, an outside surface of the absorbent material may be coated with a waxy or similar layer in order to increase the gloss and appearance of this outside surface.

Figure 4:
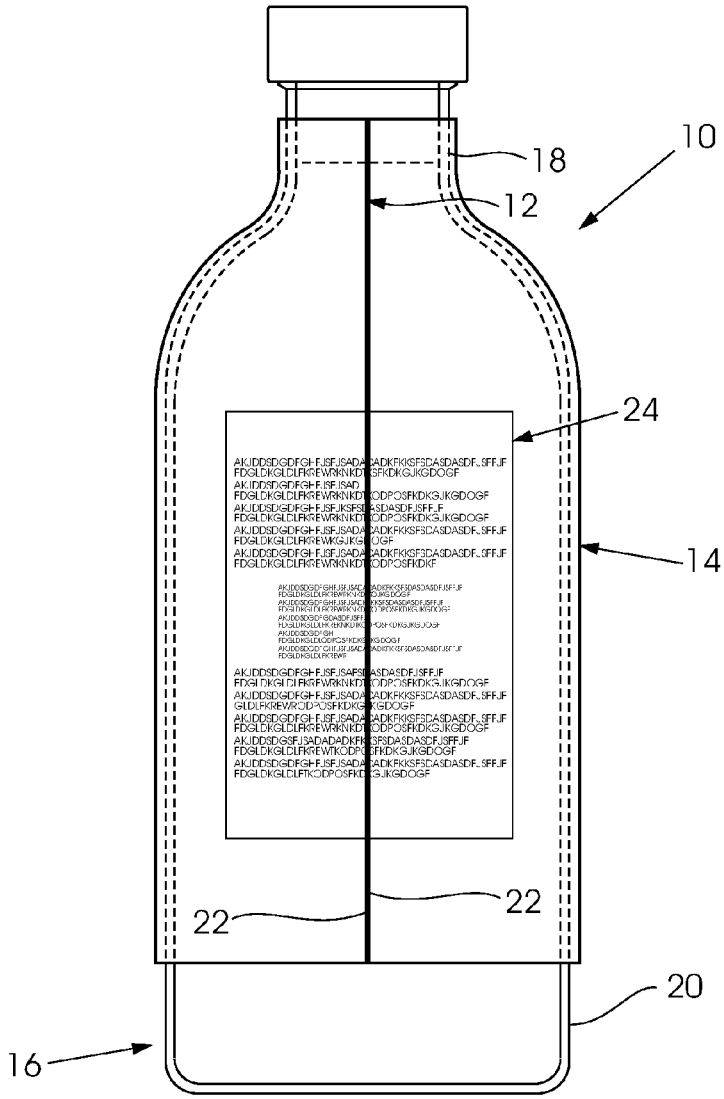
FIG. 4 is a side view of a flexible body of a drip guard, the flexible body being shown as fitted to a liquid container.

The flexibility of the body (14) enables a user or a manufacturer to easily wrap the body (14) around the liquid container (16). It is envisaged that the body (14) can be wrapped around and secured, by the securement means (12), to a neck region (18) or a body region (20) or both the neck region (18) and the body region (20) of the liquid container (16). The fact that the body (14) is wrapped around the liquid container (16) and tightly secured thereto, as illustrated in FIG. 1 and FIG. 4, means that there is not a resultant reduction in pressure when the bottle is tilted, as in the drip-stop ring, which causes a loose association between the absorbent material and the liquid container (16), this loose association is not preferable when trying to ensure maximum absorption.

It is envisaged that the body (14) may wrap around the liquid container (16) such that one end (22) of the body (14) meets or alternatively overlaps with the other end (22) of the body (14). This feature enables the body (14) to be fitted to differently sized liquid containers as where the container is smaller the ends will overlap more and where the container is larger the ends will either overlap less or merely touch. The overlapping or touching ends (22) of the body (14) are then secured to the liquid container (16) or to each other by a securement means (12), in such a manner so as, to ensure that the body (14) cannot slide off the liquid container (16). The overlapping or touching ends (22) may also be secured to each other as well as to the liquid container (16). Alternatively, the body (14) may only partially encompass, either the neck region (18), the body region (20) or both the neck region (18) and the body region (20) of the liquid container (16) and in this instance the ends (22) of the body (14) will not meet and not overlap but each end (22) will be fitted with a separate securement means (12) which is used to secure that end (22) directly to the liquid container (16) or to the other end (22) of the body (14). It is envisaged that the body (14) may be manufactured from a resilient material which can be fitted around the liquid container (16), the resiliency of the material causing contact to be maintained between the body (14) and the liquid container (16) such that no separate securement means is required. It is also envisaged that the body (14) may wrap around the liquid container (16) and have extended ends (23) which extend outwardly away from the liquid container (16), as shown in FIG. 5.

The extended ends (23) can generally be square or rectangular in shape but it is envisaged that the extensions (23) may be various shapes such as, but not limited to, wave-shaped extensions.

The body (14) may have indicia (24) directly printed thereon, by inkjet printing or other alternative printing means, or alternatively affixed thereto by means of a label or by means of a leaflet. It is also envisaged that the body (14) may be blank or have a blank leaflet-like attachment affixed thereto, the blank body (14) or blank leaflet-like attachment thereby providing a surface upon which personal messages may be written. The leaflet is either irremovably affixed to the body (14) but more preferably the leaflet is affixed to the body (14) in a manner which allows for the removal of the leaflet by the user. The leaflet may be affixed to the body (14) such that it flaps out from the side of the body (14) or a center portion of the leaflet may be affixed to the body (14) such that the leaflet does not flap out from the side of the body (14). It is envisaged that a first portion of the leaflet may be an integral part of the body (14) or secured directly to the body (14), using a securement means, such as an adhesive securement means, an interlinking securement means, such as pin systems or bolt systems, or another type of securement means, and a second portion of the leaflet may be removable from the first portion by tearing the second portion away from the first portion. To facilitate tearing there may be a perforated strip located between the first portion and the second portion. Given that the second portion of the leaflet can be removed from the body the user will be able to keep the second portion of the leaflet containing any indicia of interest to him. It is envisaged that other means of securing leaflets to the body, not specifically described herein, may also be used. It is envisaged that removable labels may also be used and where such labels are used the user, as with the leaflet as explained above, will be able to keep the label containing indicia of interest to him.

Figure 5:
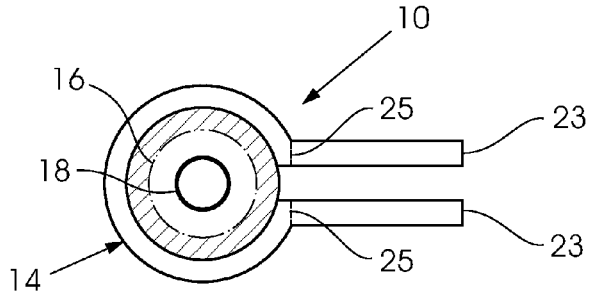
FIG. 5 is a top view of an alternate example embodiment of the drip guard of FIG. 4, wherein the flexible body of the drip guard has extended ends.

It is also envisaged that the indicia (24) may be printed on the extended ends (23) of the body (14), as shown in FIG. 5. The extended ends (23) may be exactly the same length as each other or may be of different lengths. It is further envisaged that these extended ends (23) may be removable by tearing them away from the portion of the body (14), which is attached to the liquid container (16). To make tearing the extended ends (23) away from the body (14) easier it is envisaged that there may be a perforated strip (25) located between the portion of the body (14) which is attached to the liquid container (16) and the extended ends (23) which are not attached to the liquid container (16).

The indicia (24) may be advertising indicia, including branding, or promotional indicia, for example indicia relating to various competitions or promotions in respect of the product contained in the liquid container. This implies that a range of products, including but not limited to, beverages such as wines and soft drinks may be used as medium to which advertising or promotional indicia for the product contained within the beverage container, alternatively a related product, further alternatively an unrelated product or service or event, for example a sports event such as soccer, can be attached It is also envisaged that the indicia (24) may be product information or product warnings, relating to the product contained within the liquid container (16). This is particularly relevant where the product is a hazardous substance or a potentially hazardous substance such as a chemical or a liquid medicament. Product warnings may include, but are not limited to, toxicity warnings, in the case of chemicals and contraindications, in the case of liquid medicaments.

It is further envisaged that the indicia (24) may be personal messages. As such the drip guard (10) can provide a means by which a gift can be customised by including personal greetings such as, but not limited to, birthday messages and Valentine's Day messages which are either printed directly on to the body (14), the extended ends (23) of the body (14) or on to a label or leaflet which is then affixed to the body (14), as described above. Alternatively, it is envisaged that the body (14) or leaflet may be blank so as to allow the user to add their own personal messages thereto.

As explained above, the body (14) is secured to the liquid container (16) either by a separate securement means (12) or through an integrated securement means, the integrated securement means being the resiliency of the body material. It is envisaged that the securement means (12) may be an adhesive securement means, such as glue or adhesive tape, or an interlinking securement means, such as pin systems, bolt systems, interlinking structural elements or hook and pile fasteners, or a magnetic securement means. It is envisaged that other securement means (12) and systems for securement of the body (14) to the liquid container (16), not specifically described herein, may also be used.

Figure 6:
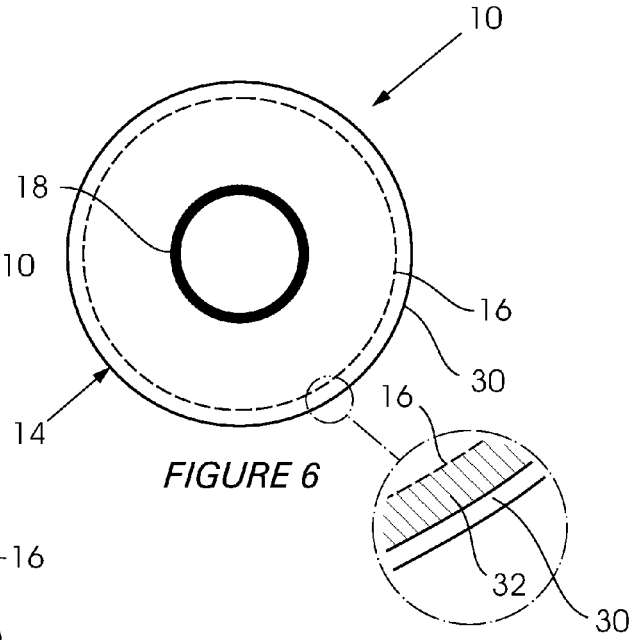
FIG. 6 is a top view of the flexible body shown in FIG. 4.

In FIG. 6 a first example embodiment of the body (14) is shown. In this embodiment the body (14) has an outer layer (30) and an absorbent layer (32). The absorbent layer (32) may be made of felt, filter paper, cotton wool, sponge or another type of absorbent material. The underside of the outer layer (30) collars the absorbent layer (32) and thereby holds the absorbent layer (32) in abutment with the outside of the liquid container (16), particularly the neck region (18) of the liquid container (16). It is also envisaged that the absorbent layer (32) may or may not be not be affixed to the outer layer (30). Where the absorbent layer (32) is not affixed, generally by means of an adhesive, to the outer layer (30), it is merely held in abutment against the liquid container (16) by the outer layer (30).

Figure 7:
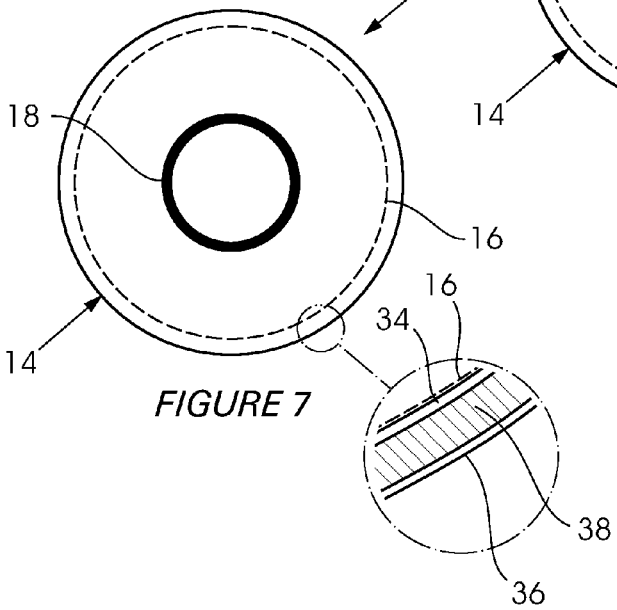
FIG. 7 is a top view of an alternate example embodiment of the flexible body of FIG. 4.

In FIG. 7 a second example embodiment of the body (14) is shown. In this embodiment the body (14) is made up of an inner layer (34), an outer layer (36) and an absorbent layer (38) sandwiched between the inner layer (34) and the outer layer (36). The inner layer (34) is securable to the liquid container (16), particularly a neck region (18) of the liquid container (16), so that the body (14) is placed in abutment with the liquid container (16). It is envisaged that the absorbent layer (38) may be fixed to both the inner layer (34) and the outer layer (36) or to only the inner layer (34) or to only the outer layer (36) or affixed to neither layer and merely held tightly sandwiched between the layers when the layers are affixed to the liquid container (16).

It is envisaged that the outer layer (30) of the body (14) may be made of an absorbent material thereby circumventing the need for an additional absorbent layer. The absorbent layer (32; 38) or absorbent material of the outer layer (30) absorbs the liquid droplets and/or condensation. It is envisaged that the absorbent material or the absorbent layer (32; 38) may tightly bind droplets or sequester droplets. This helps prevent staining of surfaces, where the liquid is a beverage that causes stains, such as wine and can help prevent a user or a surface coming into contact with a potentially hazardous chemical. In addition, the absorbent layer or absorbent material may also contain neutralizing agents which bind to and inactivate a chemical contained in the droplets, for example the absorbent layer may contain activated carbon to bind to and inactivate ethidium bromide. If the drip guard (10) becomes contaminated or if it contains a large amount of sequestered hazardous chemical it can be easily removed from the liquid container (16) and disposed of. Further additionally, the absorbent layer (32; 38) or absorbent material may contain antimicrobial or biocidal agents which inhibit or kill microorganisms in the sequestered liquid.

Referring to FIGS. 1 to 3 and 8 the spout attachment (52) is described in further detail here below:

The spout attachment (52) extends from the neck region (18) of the liquid container (16). The spout attachment (52) acts as a channel through which the liquid can be poured.

Figure 2:
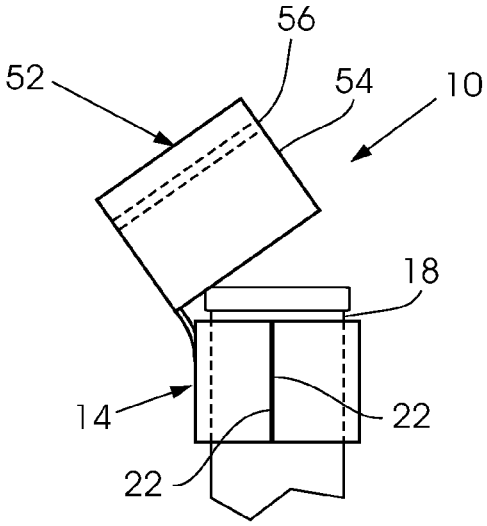
FIG. 2 is a side view of a first alternate example embodiment of the drip guard of FIG. 1 wherein the spout attachment is releasably securable to the flexible body.
Figure 3:
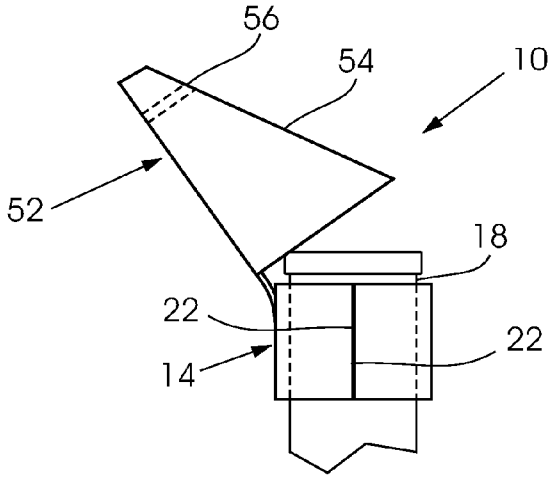
FIG. 3 is a side view of a second alternate example embodiment of the drip guard of FIG. 1.

The spout attachment (52) may be integrally formed with the body (14), as shown in FIG. 1, or the spout attachment (52) may be releasably securable to the flexible body (14), as shown in FIGS. 2 and 3. It is envisaged that the spout attachment (52) may be integrally formed with a body (14) which is fitted to the neck region (18) of the liquid container (16), or with a body (14) which is fittable to both the neck region (18) and the body region (20) of the liquid container (16). The spout attachment (52) may be releasably secured to the flexible body (14) by an adhesive securement means, for example glue or adhesive tape, or by an interlinking securement means, for example a pin system, or by a magnetic securement means. It is envisaged that other securement means, not specifically described herein, may be used to secure the spout attachment (52) to the flexible body (14).

It is envisaged that the spout attachment (52) may be structured as a straight spout, as shown in FIGS. 1 and 2 or that it may be structured as a tapered spout, as shown in FIG. 3. The tapered spout makes pouring of the liquid from the liquid container (16) easier and allows for more accurate directional control when pouring liquid from the liquid container (16).

The spout attachment (52) has a spout housing (54) and at least one sieve component (56) located within an inner portion of the spout housing (54). The sieve component (56) may be integrally formed within the spout housing (54) of the spout attachment (52) or may be removable from the spout housing (54) so that the sieve component (56) can be removed and replaced. The sieve component (56) primarily acts as a sieve or a filter to remove particulate matter or suspended particles, such as but not limited to fragments of cork in the case of wine, from the liquid being poured from the liquid container (16). The sieve component (56) may also assist with the aeration of liquids, such as wine, where aeration thereof is advantageous. The spout housing (54) may be of such a design or shape that it assists with the aeration of liquids when the liquids are poured through the spout housing (54), for example, it is envisaged that ridges (not shown) may be built into the inner portion of the spout housing (54), the ridges facilitating the aeration of the liquid.

The sieve component (56) may also act as a support to hold adjuncts, preferably adjuvants but which are not separately dispensed themselves but which interact with the liquid prior to dispensing alternatively that the sieve component (56) acts as a support to hold adjuncts which are themselves dispensed when the liquid is poured from the liquid container (16). The adjuncts may be supplements or vitamins or concentrates which are added to a beverage, for example, or additional chemicals, such as catalysts or biocides, the catalysts being used to speed up a chemical reaction and the biocides being used to kill microorganisms in the liquid being dispensed or in the container into which the liquid is poured. The adjuvants may, for example, be medicaments that enhance the effect of the liquid medicament contained within the liquid container (16). It is envisaged that other types of adjuncts and adjuvants may be supported by the sieve component (56).

The sieve component (56) may also contain neutralizing agents, similar to those agents described above, to trap and inactivate hazardous chemicals. For example the sieve component (56) may contain activated charcoal to trap and bind pesticides, heavy metals and various other hazardous chemicals. It is envisaged that the spout attachment (52) may contain a number of sieve components (56) having the same or different size meshes and having either the same or different neutralizing agents contained therein.

Figure 8:
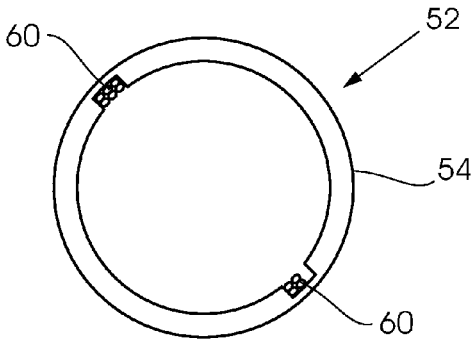
FIG. 8 is a top view of an alternate embodiment of a spout attachment the spout attachment having at least one compartment located therein.

In FIG. 8 an alternate embodiment of the spout attachment (52) is shown. In this embodiment the inner portion of the spout housing (54) has at least one compartment (60), more preferably a number of compartments, located therein. The compartment (60) functions to contain adjuncts or adjuvants, such as, but not limited to, flavourants, vitamins and lubricants. The compartments (60) will contain a pre-determined amount of adjuvant or adjunct which is then added to the liquid when the liquid is poured, the liquid coming into contact with the compartment (60) when the liquid is poured from the liquid container (16). The compartment (60) may be an enclosed compartment that only opens when it comes into contact with the liquid or alternatively the compartment may be an enclosable compartment or a compartment with a predetermined mesh size, the rate of movement of the adjuncts or adjuvants out of the compartment (60) being determined in part by the mesh size.

It is envisaged that a spout attachment (52) having both sieve components (56) and compartments (60) may be manufactured.

It is also envisaged that the spout attachment (52) may be manufactured so as to have no sieve components (56) or filtering apparatus associated therewith. Spout attachments (52) of this nature would be particularly applicable in the wine industry as such attachments could be used to assist in and facilitate the aeration of the wine prior to drinking.

It is also envisaged that the spout attachment (52) may have a spout housing (54) that is designed so as to facilitate the aeration of the liquid by agitation or the Venturi effect and that the spout attachment (52) has sieve components (56) associated therewith to remove particulate matter (such as bits of cork in the case of wine) from the liquid.

It will be appreciated by a person skilled in the art that drip guards (10) (as described above) may be manufactured and sold in various formats. It is envisaged that the drip guard (10) may be sold already attached to the liquid container (16) with the integrally formed spout attachment (52) already present or in the case of a releasably securable spout attachment (52) it is envisaged that the spout attachment (52) is either already attached to the flexible body (14) at the time of sale or that it is attachable after sale. It is envisaged that the spout attachment (52) may be an integrally formed spout attachment or that it may be a releasably securable spout attachment (52).

This description delineates various example embodiments of the invention but it will be appreciated that there are various alternative types of drip guards (10) not necessarily described herein but which are within the scope of the appended claims. While this invention has been described as having an exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A drip guard in which at least one of condensation and liquid droplets formed on an outer surface of a bottle are absorbed, the bottle having a neck portion with a pouring portion for pouring liquid from the bottle, the drip guard comprising:

a flexible body shaped and dimensioned to be wrapped around and to be secured onto an outer surface of the neck portion of the bottle below the pouring portion, the flexible body including an absorptive material, in use to absorb at least one of liquid droplets and condensation;

securement means, attached to the flexible body, for facilitating the securement of the flexible body to the bottle; and a spout attachment extending from the flexible body proximate to the pouring portion and without abutting the pouring portion, the positioning of the spout attachment by the flexible body operatively to act as a channel external to the neck of the bottle with the channel being spaced from the neck of the bottle for pouring liquid from the bottle and for providing directional control over the pouring liquid.

2. The drip guard, as claimed in claim 1, wherein the spout attachment is integrally formed with the flexible body.

3. The drip guard, as claimed in claim 1, wherein the spout attachment is attached or attachable to the flexible body.

4. The drip guard, as claimed in claim 1, wherein the spout attachment has a spout housing that has at least one sieve component located within an inner portion of the spout housing, the at least one sieve component adapted to either filter or aerate the liquid.

5. The drip guard, as claimed in claim 1, wherein the spout attachment has a spout housing that includes a surface within an inner portion of the spout housing which accommodates adjuncts to be contacted with or added to the liquid.

6. The drip guard, as claimed in claim 1, wherein the spout attachment has a spout housing that has at least one compartment located within an inner portion of the spout housing, which compartment functions to contain adjuncts which adjuncts are, in use, contacted with or added to the liquid.

7. The drip guard, as claimed in claim 1, wherein the flexible body comprises an outer layer and an absorbent layer, the outer layer collaring the absorbent layer such that, in use the absorbent layer is held in abutment with the bottle and the absorbent layer functioning to absorb the liquid droplets.

8. The drip guard, as claimed in claim 1, wherein the flexible body comprises an outer layer, an absorbent layer and an inner layer, the absorbent layer being sandwiched between the outer layer and the inner layer and the inner layer abutting the bottle.

9. The drip guard as claimed in claim 7, wherein the absorbent layer contains antimicrobial or biocidal agents which, in use, inhibit the growth of or kill microorganisms in liquid sequestered in the absorbent layer.

10. The drip guard as claimed in claim 8, wherein the absorbent layer contains antimicrobial or biocidal agents which, in use, inhibit the growth of or kill microorganisms in liquid sequestered in the absorbent layer.

11. The drip guard, as claimed in claim 1, wherein the securement means comprises a separate securement means, and is selected from the group comprising an adhesive, an interlinking mechanism and a magnetic element.

12. The drip guard, as claimed in claim 1, wherein the flexible body wraps around the neck of the bottle so that an end of the body either overlaps or touches an opposite end of the body and positions the spout attachment proximate the pouring portion of the neck.

13. The drip guard, as claimed in claim 1, wherein the securement means comprises an integrated securement means, the integrated securement means being provided by the resiliency of the flexible body, which exerts a pressure against the bottle when the flexible body is wrapped around the neck of the bottle.

14. A drip guard for absorbing condensation and liquid droplets formed on an outer surface of a bottle, the bottle having a neck portion with a pouring portion for pouring liquid from the bottle, the drip guard comprising:

a flexible body having sufficient material and flexibility to wrap around and secure onto an outer surface of the neck portion of the bottle, the flexible body including an absorptive material adapted to absorb liquid droplets and condensation;

securement means, attached to the flexible body, for facilitating the securement of the flexible body in a wrapped around configuration to the bottle; and a tapered spout attachment extending from the flexible body proximate to the neck portion of the bottle, the tapered spout attachment being external to the neck portion of the bottle and spaced from the neck portion of the bottle proximate the pouring portion and without abutting the pouring portion in an arrangement such that liquid pouring from the bottle enters the tapered spout attachment and the spout attachment provides directional control over the pouring liquid.

* * * * *